US005327832A

United States Patent [19]

Fischer

[11] Patent Number: 5,327,832

[45] Date of Patent: Jul. 12, 1994

[54] PRINTING PLATE ADJUSTING ASSEMBLY

[75] Inventor: Christian M. M. Fischer, Marktheidenfeld, Fed. Rep. of Germany

[73] Assignee: Koenig & Bauer Aktiengesellschaft, Wurzburg, Fed. Rep. of Germany

[21] Appl. No.: 953,871

[22] Filed: Sep. 30, 1992

[30] Foreign Application Priority Data

Oct. 2, 1991 [DE] Fed. Rep. of Germany ..... 4132805

[51] Int. Cl.[5] ..... B41F 1/28

[52] U.S. Cl. ..... 101/415.1; 101/DIG. 36

[58] Field of Search ..... 101/378, 415.1, DIG. 36, 101/486

[56] References Cited

U.S. PATENT DOCUMENTS

| | | | |
|---|---|---|---|
| 3,835,778 | 9/1974 | Bock | 101/415.1 |
| 3,858,512 | 1/1975 | Simeth | 101/415.1 |
| 4,641,577 | 2/1987 | Sweeny | 101/415.1 |
| 4,748,911 | 6/1988 | Kobler | 101/378 |
| 4,862,800 | 9/1989 | Wieland et al. | 101/415.1 |

FOREIGN PATENT DOCUMENTS

| | | |
|---|---|---|
| 318702 | 2/1920 | Fed. Rep. of Germany . |
| 2045953 | 9/1970 | Fed. Rep. of Germany . |
| 8436119 | 12/1984 | Fed. Rep. of Germany . |
| 2213614 | 12/1985 | Fed. Rep. of Germany . |
| 3545297 | 12/1985 | Fed. Rep. of Germany . |
| 2540433 | 8/1984 | France . |

OTHER PUBLICATIONS

Grapho Metronic Information; Jan. 5-8, 1992.

*Primary Examiner*—Edgar S. Burr
*Assistant Examiner*—Ren Yan
*Attorney, Agent, or Firm*—Jones, Tullar & Cooper

[57] ABSTRACT

A printing plate adjusting assembly which is usable to effect side register adjustment of printing plates on a plate cylinder utilizes a plurality of individually axially shiftable insert bars carried in a cylinder groove. Each insert bar has a printing plate engaging register pin. Differentially threaded screws are usable to shift one bar with respect to another.

2 Claims, 2 Drawing Sheets

PRINTING PLATE ADJUSTING ASSEMBLY

FIELD OF THE INVENTION

The present invention is directed generally to a printing plate adjusting assembly. More particularly, the present invention is directed to a printing plate side register adjusting assembly. Most specifically, the present invention is directed to a side register adjusting assembly for applying printing plates to plate cylinders. The printing plates are secured to a plate cylinder of a rotary printing press and can be adjusted axially along the surface of the plate cylinder to ensure that the side registry of the printing plates will be correct. Each printing plate of a possible plurality of printing plates that can be secured to the plate cylinder's surface can be brought into proper side registry by use of slideable inserted bars which have register pins that engage slots in the ends of the printing plates.

DESCRIPTION OF THE PRIOR ART

It is generally known in the field of printing, and particularly in the area of web-fed rotary printing, that the paper web being printed on is quite likely to change in width during printing. This change in width can be the result of various factors such as the physical characteristics and condition of the paper web, the amount of dampening fluid that the paper web may absorb during printing and the like. Such changes in width of the paper web can also be different from one printing unit to another printing unit. Further, such changes in paper web width typically increase is magnitude from the middle of the web or of the cylinder outwardly toward the outer edges of the web or the outer sides of the cylinder. The changes in the paper web width require repositioning of the various printing plates attached to the surface of the plate cylinder to maintain proper alignment or register of the printing plates with regard to the paper web and the side lays.

In one prior art device which is shown in German patent specification No. 20 45 953, printing plates are laterally adjusted or shifted on the surface of the plate cylinder in relation to each other. This is accomplished by providing each printing plate with trapezoidally-shaped stops which are laterally fixed in the clamping channel and executed as clamping bushings. A disadvantage of this prior art assembly is that each printing plate has to have two such stop pieces provided in the clamping channel having a certain width. A wide clamping channel is apt to lead to an untrue run of the plate cylinder. This is a result of the oscillations of the printing cylinder caused by the wide channels. These oscillations lead to register deviations.

In the German patent specification No. 35 45 297 there is shown another adjustable side register arrangement for plate cylinders of rotary presses. In this prior art device, the ends of the adjacent printing plates carried on the plate cylinder are bent inwardly and are received in a cylinder groove. These plate ends have recesses or apertures which receive register pins or plates of a register assembly which is used to adjust the position of the plates on the plate cylinder. The outer register pin and the smaller or inner register pin, taken in the axial direction of the plate cylinder are telescopically slideable with respect to each other and are carried by a joint adjustment screw which is positioned on one of the side faces of the plate cylinder. The inner and outer register plates or pins are each carried at the inner ends of inner and outer adjustment pins. The inner adjustment piece has external threads while the outer adjustment piece has internal threads. These external and internal threads are of differing pitch and are both engaged by the cooperatively threaded portions of the joint adjustment screw. The threaded pitches are selected so that the outer printing plate is shifted to a greater extent than the inner printing plate, taken toward the middle of the plate cylinder, upon rotation of the joint adjustment screw.

One limitation of this prior art printing plate register adjusting assembly is that the printing plates which are arranged toward the center or middle of the plate cylinder can only be adjusted jointly. This means that it must be presupposed that the paper web always changes during printing; i.e. that it stretches itself in accordance with the different dimensions and pitches of the threads of the two adjustment pieces. However, this is not always the case since the stretching of the paper webs can be different from web to web as this is a characteristic of the quality of the paper as well as the amount of dampening fluid that is on the printing plates. There is also a relatively large amount of play in this prior art side register adjusting assembly because of the joint thread guides for the internal and external screw threads.

Another limitation of this prior side register adjusting assembly is that the inner register pins or plates, which are positioned generally near the middle of the plate cylinder, have a significant amount of play. This is due to the telescoping nature of the support of the inner register pins within the outer register pins. This prior art device also requires that a costly precision borehole be made in the plate cylinder in alignment with, and parallel to the axis of the cylinder. This borehole receives the adjustment piece with the inner and outer register plates or pieces.

A further limitation of this prior art side register adjusting assembly is that since the housing for the assembly must be placed on the side face of the plate cylinder, it is not possible to place thrust rings or so-called bearer rings on the plate cylinder. These rings are typically attached to the side faces of the plate cylinders and adjacent these faces. When the housing for the lateral adjustment devices of this prior art assembly is attached to the cylinder's side face, it is not possible to attach the bearer rings. Finally, it is also a limitation of this prior art device that if the lateral adjusting assembly wears out or breaks, the entire printing unit cylinder must be dismounted so that the lateral adjustment device can be dismantled and repaired.

It will be apparent that a need exists for a printing plate register adjusting assembly which overcomes the limitations of the prior art devices. The printing plate adjusting device provides such an assembly and is a significant advance over the prior art devices.

SUMMARY OF THE INVENTION

It is an object of the present invention to provide a printing plate adjusting assembly.

Another object of the present invention is to provide a printing plate side register adjusting assembly.

A further object of the present invention is to provide a side register adjusting assembly for applying printing plates to plate cylinders.

Still another object of the present invention is to provide a side register adjusting assembly for printing plates having plate beginnings which are bent more than 90°.

Yet a further object of the present invention is to provide a printing plate adjusting assembly in which the printing plate's bent beginning ends are positioned in a narrow cylinder channel.

Still another object of the present invention is to provide a printing plate adjusting assembly in which the printing plates are individually adjustable on the plate cylinder.

As will be discussed in greater detail in the description of the preferred embodiment which is set forth subsequently, the printing plate adjusting assembly in accordance with the present invention utilizes a plurality of bars which are inserted into and held in place in an axially extending groove on the periphery of the plate cylinder. Each inserted bar has at least one register pin which extends out from a side surface of the bar into a thin gap formed between the side of the bar and the side of the cylinder groove. The bent beginning end of a printing plate has a slot that receives this register pin. Each bar is individually slideable axially along the cylinder groove to effect an axially shifting of its corresponding printing plate end. This axial shifting of each printing plate is utilized to effect the desired side register adjustment of the printing plates on the periphery of the plate cylinder.

A significant advantage of the printing plate adjusting assembly of the present invention is that the individual printing plates are each shiftable axially on the surface of the plate cylinder. This is due to the individual shiftable structure of the various bars that are positioned in the cylinder groove. Since each bar is individually shiftable, the printing plates, each of which is secured to a separate bar, are individually shiftable. This allows the various stretching characteristics of the paper webs, which are a function of the various amounts of dampening fluid on the various printing plates, to be accommodated.

The printing plate adjusting assembly of the present invention also is usable with printing cylinders that have bearer rings. The use of the cylinder groove and the placement of the various individual bars in the cylinder groove leaves the end faces of the plate cylinder free and unobstructed. This allows suitable bearer rings to be attached to the ends of the cylinders.

Other benefits of the printing plate adjusting assembly of the present invention reside in the elimination of the precision boreholes that are required by the prior art device. Additionally, repair or maintenance work can readily be accomplished without the need to dismount the plate cylinder from the printing press frame. The use of the individual inserted bars placed in the channel on the surface of the plate cylinder reduces the channel space to a width required for receipt of the bent ends of two printing plates. This very minimal cylinder channel space eliminates the cylinder oscillations that have been a problem with prior art cylinders having wide channel spaces or cylinder grooves.

It will thus be seen that the printing plate adjusting assembly in accordance with the present invention overcomes the limitations of the prior art devices. The present side register printing plate adjusting assembly is a substantial advance in the art.

BRIEF DESCRIPTION OF THE DRAWINGS

While the novel features of the printing plate adjusting assembly in accordance with the present invention are set forth with particularity in the appended claims, a full and complete understanding of the invention may be had by referring to the detailed description of the preferred embodiment which is set forth subsequently, and as illustrated in the accompanying drawings, in which:

DESCRIPTION OF THE PREFERRED EMBODIMENT

Figure 1:
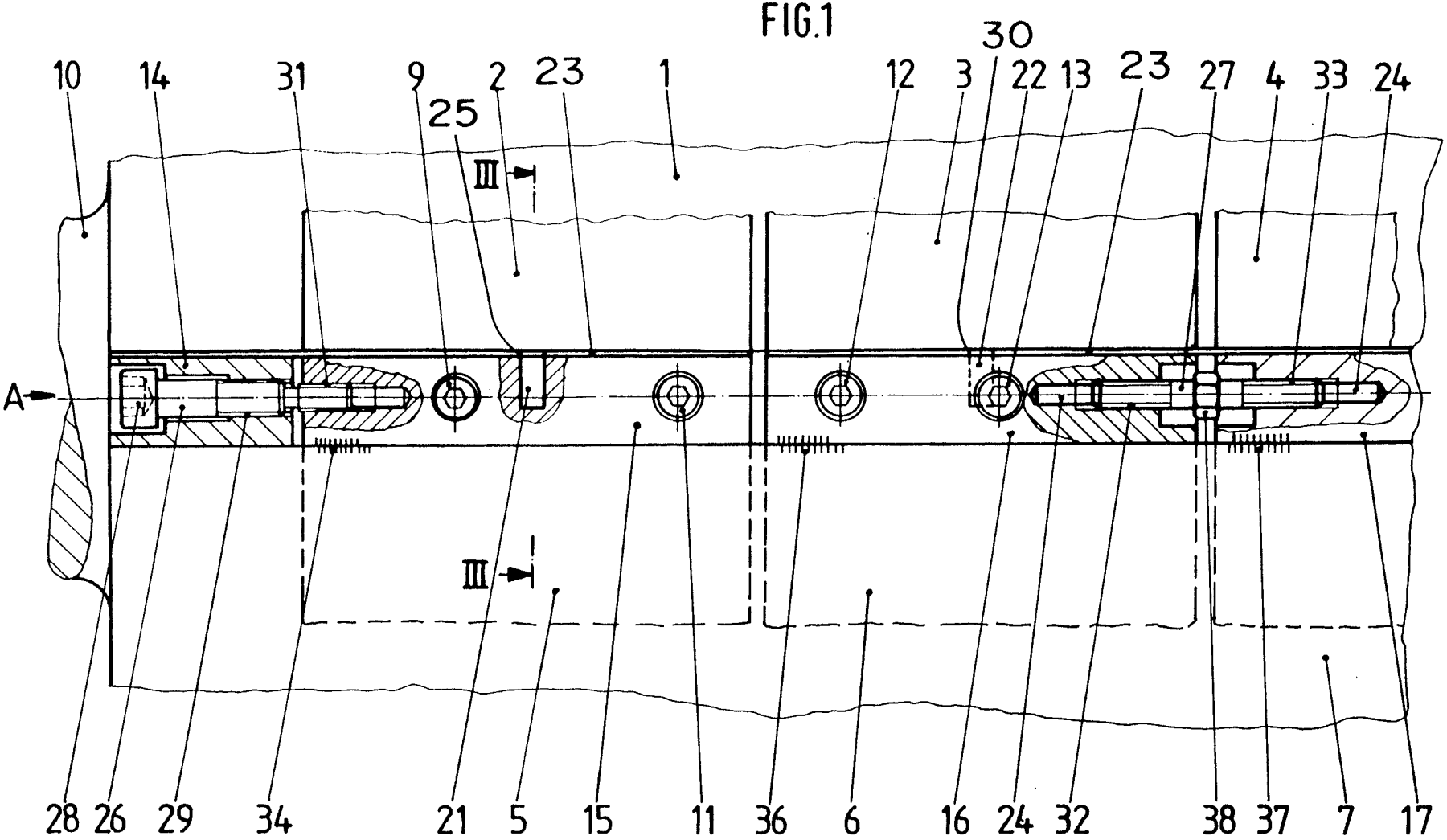
FIG. 1 is a front elevation view of a portion of a printing plate cylinder utilizing the printing plate adjusting assembly of the present invention.

Referring initially to FIG. 1, there may be seen a preferred embodiment of a printing plate adjusting assembly in accordance with the present invention. This printing plate adjusting assembly is intended for use in adjusting the side register of printing plates applied to a plate cylinder. As may be seen in FIG. 1, there is depicted a partial front view of a printing plate cylinder 1 which has a plurality of flexible printing plates 2–7 secured to its outer surface. It will be understood that printing cylinder 1 typically carries a total of eight printing plates on the surface and that portions of only six of these plates are depicted at 2–7. It will further be understood that the printing plate adjusting assembly depicted and to be discussed subsequently will typically have a counterpart on the diametrically opposing side of the printing plate cylinder 1. Thus both the leading and trailing edges of each printing plate 2–7 attached to the surface of the plate cylinder 1 will be adjustable to provide proper side register adjustment. It will further be understood that plate cylinder 1 is provided with suitable axle trunnions or journals 10 at either end which are utilized to rotatably support the plate cylinder 1 between side frames not specifically depicted of the web-fed rotary printing press with which the subject invention is typically used.

Figure 2:
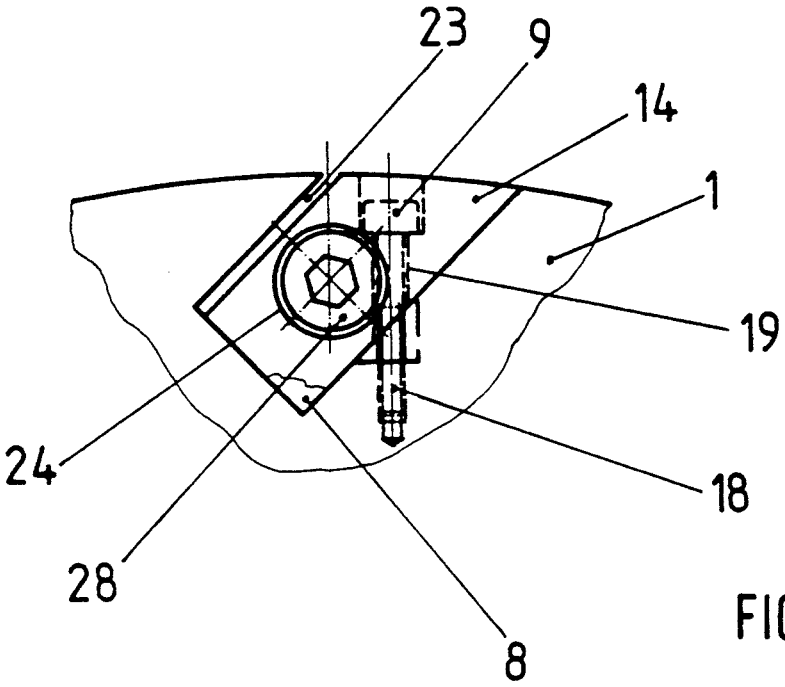
FIG. 2 is an end view of a portion of the printing plate cylinder taken in the direction indicated by arrow A in FIG. 1.
Figure 3:
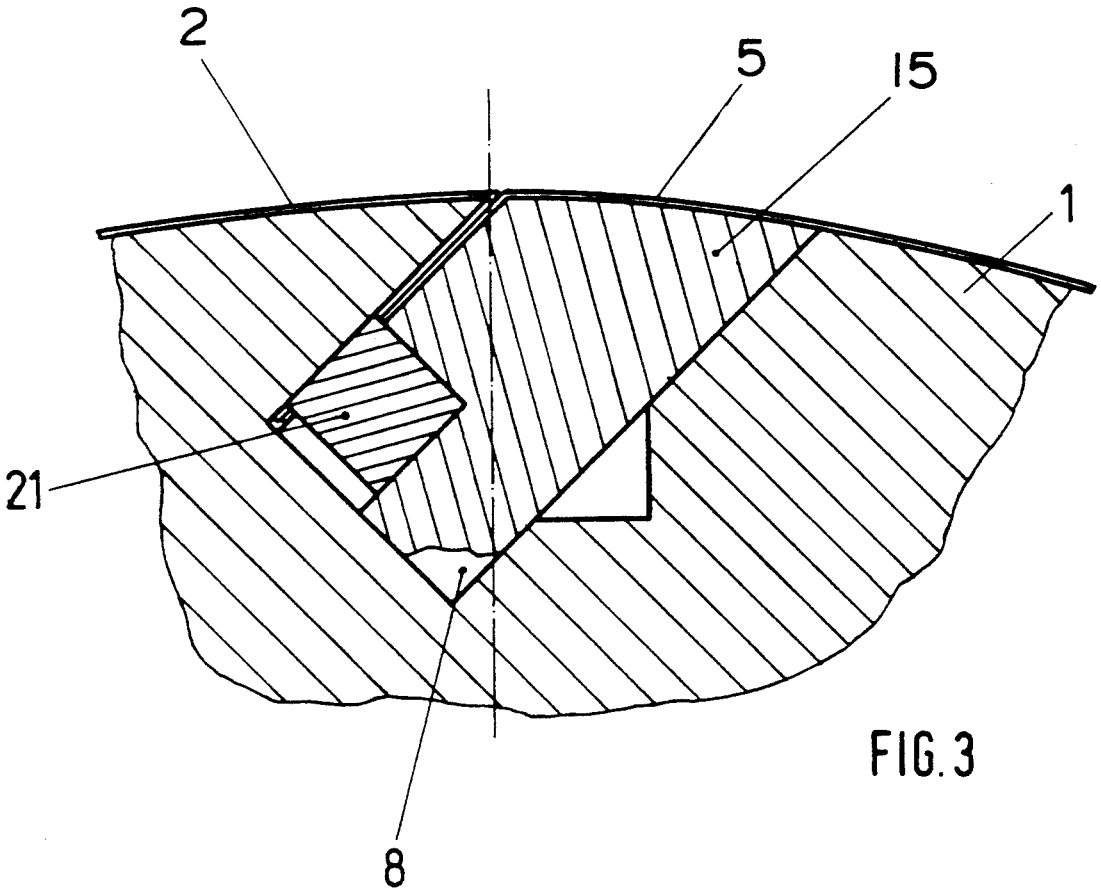
FIG. 3 is a cross-sectional view of a portion of the printing plate cylinder taken along line III—III of FIG. 1.

Again referring to FIG. 1 and taken in conjunction with FIGS. 2 and 3 the printing plate cylinder 1 has a cylinder groove 8 at its circumference. This cylinder groove 8 extends along the circumference of cylinder 1 parallel to an axis of rotation of cylinder 1. This cylinder groove can easily be milled or otherwise formed in the outer peripheral surface of printing plate cylinder 1.

A plurality of separate inserted bars 14, 15, 16, and 17 are adjustably received in cylinder groove 8. Each bar 14–17 is held in place in groove 8 by a pair of spaced screws such as the ones depicted at 9, 11, 12, and 13. The screws used to secure inserted bar 14 are not specifically depicted in FIG. 1. Each such screw 9, 11, 12, and 13 passes through an axially elongated slot or aperture 19 in its respective inserted bar 14–17 and then is received in a threaded bore or tap hole 18 formed in the cylinder groove 8, as may be seen most clearly in FIG. 2. Each of these screws 9, 11, 12, and 13 has an enlarged head whose lower surface is engageable with a shoulder of the axially enlarged slot or aperture. When the screws, such as screws 9 and 11 are loosened, the inserted bar 15 can slide axially in the cylinder groove 8. When the screws, such as screws 9 and 11 are tightened the inserted bar, such as bar 15 will be held securely in the cylinder groove 8.

Referring again to FIG. 1, and as may also be seen in FIG. 3, each inserted bar carries a register pin 21 or 22 which extends out from a lower side of the inserted bar 15 or 16 into a cylinder channel 23 which is the space left in the cylinder groove 8 after the bar 15 or 16 has been inserted therein. Each register pin 21 or 22 is made of a hard metal and can be glued or otherwise secured to the side of the inserted bar, such as bar 15. As may be seen in FIGS. 1 and 3, each bent end of a printing plate, such as plates 2 and 5 or plates 3 and 6 has a slot 25 or 30 which is sized to cooperate with register pin 21 or 22. The register pin 21 or 22 of the bar 15 or 16 is received in the cooperatively sized slots 25 or 30 in the ends of the printing plates 2 and 5 or 3 and 6 when the plate ends are placed in the cylinder groove 8. As may be seen in FIG. 3, the cylinder channel 23 between the side of the bar 15 and the side of the cylinder groove 8 is just wide enough to accept the bent ends of the two plates 2 and 5 or 3 and 6.

Returning to FIG. 1, each of the inserted bars 14–17 has an axially extending borehole or boreholes 24 with each of these boreholes 24 being sized to receive a differential screw 26 or 27. As seen in FIGS. 1 and 2, the differential screw 26 which is used with bars 14 and 15 has an internal hexagon head 28 that is accessible from an end face of the plate cylinder 1. The differential screw 26 has two threaded shank portions 29 and 31 with the first threaded shank portion 29 being screwed in the threaded bore 24 of the bar 14 and with the second threaded shank portion 31 being received in the threaded bore 24 at an outer end of the inserted bar 15. The first threaded part 29 may have a thread M8×1.25 and the second threaded part 31 may have a thread M6×1.

The differential screw 27 which is placed between the adjacent ends of two spaced inserted bars 16 and 17 has a central hex cap 38 which is engageable by a tool that can be inserted in the space between the two bars 16 and 17. This differential screw has a first threaded part 32 which may has a thread of M6×1 and a second threaded part 33 which may have a threaded of M6×0.75. These differentially threaded parts are received in the correspondingly threaded tap holes 24 in the adjacent ends of the adjacent inserted bars 16 and 17.

As may further be seen in FIG. 1, a vernier scale 34, 36, or 37 is provided between each insert bar 15, 16, 17 and the adjacent edge of the cylinder groove 8. These vernier scales 34, 36, and 37 are usable to accurately position the insert bars and to quantify changes in the position of a bar with respect to the plate cylinder 1.

In operation if, for example, the printing plate 5 is to be adjusted, the screws 9 and 11 are loosened so that the bar 15 will be free to slide axially in the cylinder groove 8. This sliding movement of the bar 15 will move the plate 5 axially since the slot in plate 5 is in engagement with the register pin 21 that is carried by the bar 15. Once the screws 9 and 11 have been loosened, the differential screw 26 may be activated by engagement of its hex head 27 with a suitable tool. Because of the thread differential between the threaded parts 29 and 31 rotation of the differential screw 26 in the fixed bar 14 and the loose bar 15 will cause the loose bar 15 and its carried printing plate 5 to move axially to effect proper side register adjustment. The change in position of the insert bar 15 can be read on the vernier scale 34 in which the scales can have a graduation of 99:100. After the adjustment has been accomplished, the screws 9 and 11 can be retightened to clamp the insert bar 15 in its new, adjusted position.

Assuming now that the printing plate 7 is to be adjusted, the screws (not shown) used to hold insert bar 17 in place in cylinder groove 8 are loosened. The hex cap 38 of the differential screw 27 can be engaged by a suitable tool and can be turned to rotate the differential screw 27. Since this screw 27 has the differentially threaded parts 32 and 33, the rotation of the differential screw 27 will cause the loosened bar 17 and hence its associated printing plate 7 to move axially with respect to the fixed bar 16. Once the plate 8 has been shifted axially by an amount measured by vernier scale 37, the bolts which had previously been loosened, can be retightened.

As may be seen by again referring to FIG. 1, it would be possible to connect the two spaced insert bars 15 and 16 by a differential screw similar to screw 27 and to eliminate the differential screw 26. Similarly, it would be possible to change the arrangement of the differential screw 27 so that it extends between the inserted bars 15 and 16 instead of the inserted bars 16 and 17. It would also be within the scope of the subject invention to substitute suitable eccentrics instead of the differential screws 26 and 27 to effect axial shifting of the inserted bars 14, 15, 16 and 17.

While a preferred embodiment of a printing plate adjusting assembly in accordance with the present invention has been fully and completely set forth hereinabove, it will be apparent to one of skill in the art that a number of changes in, for example the overall size of the printing plate cylinder, the number of printing plates carried on the plate cylinder, the support and drive assemblies for the cylinder and the like may be made without departing from the true spirit and scope of the present invention which is accordingly to be limited only by the following claims.

What is claimed is:

1. A printing plate adjusting assembly usable to effect side register adjustments of a selected one of a plurality of printing plates carried by a plate cylinder, said printing plate adjusting assembly comprising:

an axially extending cylinder groove on a peripheral surface of said plate cylinder;

a plurality of inserted bars selectably axially shiftably positioned within said cylinder groove;

a register pin on at least one of said plurality of inserted bars for engaging an end of a printing plate inserted into a cylinder channel between a side of said cylinder groove and a side of said at least one of said plurality of inserted bars, said register pin being secured in a recess in a side of said at least one of said plurality of inserted bars;

clamping screws for releasably securing each of said plurality of said inserted bars against shifting movement in said cylinder groove, each of said clamping screws passing through an axially elongated slot in its cooperating inserted bar and being received in said cylinder groove; and means for selectively axially shifting at least one of said plurality of inserted bars in said cylinder groove toward and away from the others of said plurality of inserted bars to effect side register adjustment of said printing plate whose end is engaged by said one of said plurality of inserted bars while the others of said plurality of inserted bars are secured against axial shifting, said axial shifting means including a differential screw having a first shank portion with a first thread and a second shank portion with a second thread, said first and second threads being different, said first shank portion being rotatably received in said one of said plurality of inserted bars and said second shank portion being rotatably received in an adjacent one of said plurality of inserted bars, rotation of said differential screw axially shifting said one of said plurality of inserted bars with respect to said others of said plurality of inserted bars which are secured against axial shifting.

2. The printing plate adjusting assembly of claim 1 further including a vernier scale on said one of said plurality of inserted bars and said peripheral surface of said plate cylinder to measure said axial shifting of said one of said plurality of inserted bars.

* * * * *